US007413146B2

(12) United States Patent
Quijano

(10) Patent No.: US 7,413,146 B2
(45) Date of Patent: Aug. 19, 2008

(54) CONTROL APPARATUS FOR KITE POWERED CONVEYANCE DEVICE

(76) Inventor: Luis E. Quijano, Calle Bucare #30, Apt. 2-B, San Juan, PR (US) 00913

( * ) Notice: Subject to any disclaimer, the term of this patent is extended or adjusted under 35 U.S.C. 154(b) by 331 days.

(21) Appl. No.: 10/522,684

(22) PCT Filed: Jul. 21, 2003

(86) PCT No.: PCT/IB03/03734

§ 371 (c)(1),
(2), (4) Date: Jan. 31, 2005

(87) PCT Pub. No.: WO2004/013711

PCT Pub. Date: Feb. 12, 2004

(65) Prior Publication Data

US 2006/0102794 A1 May 18, 2006

Related U.S. Application Data

(60) Provisional application No. 60/399,033, filed on Jul. 29, 2002.

(51) Int. Cl.
*A63H 27/08* (2006.01)

(52) U.S. Cl. ..... 244/155 A; 244/155 R

(58) Field of Classification Search ..... 244/155 A, 244/155 R, 153 R; 182/4, 3, 9; 114/39.18, 114/39.16, 39
See application file for complete search history.

(56) References Cited

U.S. PATENT DOCUMENTS 3,458,188 A * 7/1969 Infante ..... 472/133
4,026,547 A 5/1977 Silverstolpe et al.
4,047,255 A 9/1977 Kiefer
4,112,865 A 9/1978 Carn
4,235,182 A 11/1980 Burger
4,418,631 A 12/1983 Frohbach
4,452,161 A 6/1984 McCoy
4,458,617 A 7/1984 Eden
4,474,261 A 10/1984 Mader
4,508,045 A 4/1985 Spanier
4,588,044 A 5/1986 Mader
4,630,563 A 12/1986 Pertramer
4,708,078 A 11/1987 Legaignoux et al.

(Continued)

*Primary Examiner*—Timothy D Collins
(74) *Attorney, Agent, or Firm*—Roberto J. Rios; Hoglund & Pamias, PSC

(57) ABSTRACT

A control apparatus for a kite powered conveyance device. Port and starboard kite leads (28,32) and/or port and starboard kite control lines (30, 36) connect ends of a control bar (26, 26') to port and starboard ends of a kite (12). A tether guide (34, 34', 34") is connected to one end of the control bar (26) or to one of the kite leads (28, 32). A harness (12) with a spreader bar (18) is adapted to be worn by a user of the kite powered conveyance device. An arm (20, 20') is connected to the spreader bar (18). A tether connector (42, 42') and a hook (22, 22') are rotatably mounted on the arm (20, 20') for rotation about the longitudinal axis of the arm (20, 20'). The hook (22, 22') is hooked to the control bar (26, 26') to connect the control bar (26, 26') to the spreader bar (18). A tether (38) passes through the tether guide (34, 34', 34") and has its first end connected to the tether connector (42, 42') and its second end connected to one of the Kite control lines (30, 36).

16 Claims, 10 Drawing Sheets

U.S. PATENT DOCUMENTS

| | | | | |
|---|---|---|---|---|
| 4,712,498 | A | 12/1987 | Oser | |
| 4,741,280 | A | 5/1988 | Mauderer et al. | |
| 4,934,297 | A | 6/1990 | Long | |
| D321,234 | S | 10/1991 | Fildan | |
| 5,069,153 | A | 12/1991 | Pascher | |
| 5,195,443 | A | 3/1993 | Williams | |
| 6,273,369 | B1 | 8/2001 | Nishimura et al. | |
| 6,293,215 | B1 | 9/2001 | Moorrees | |
| 6,682,018 | B2 * | 1/2004 | Sinclaire | 244/155 A |
| 2004/0194559 | A1 * | 10/2004 | Nakamura et al. | 73/862.331 |

* cited by examiner

CONTROL APPARATUS FOR KITE POWERED CONVEYANCE DEVICE

CROSS-REFERENCE TO RELATED APPLICATION

This application claims the benefit of U.S. Provisional Patent Application Ser. No. 60/399,033 filed Jul. 29, 2002.

TECHNICAL FIELD

The present invention pertains to a control apparatus for a kite powered conveyance device. More particularly, the present invention pertains to a spreader bar assembly permitting improved control of a kite powered conveyance device, such as a surfboard, in line skates, or a similar conveyance device.

BACKGROUND ART

Kite powered conveyance devices are becoming increasingly popular for recreational purposes. By way of example kite surfing, such as depicted in FIG. 1, has rapidly become a popular water sport. In kite surfing, a person stands on a surfboard and grips a control bar which is fastened by kite control lines to opposite sides of a large kite. The person may wear a harness with a spreader bar which is hooked to the control bar. As the kite is blown by the wind, the kite tows the person on the surfboard. In addition to surfboards, other kite powered conveyance devices might include roller skates, in line skates, and bicycles, for example. The following description will generally be with reference to a kite powered surfboard, but the invention is likewise usable with other conveyance devices.

A kite powered conveyance device, such as a surfboard, is often provided with a tether connected to one side of the kite to enable the surfer to depower the kite when desired, as well as to automatically depower the kite in the event the surfer falls or otherwise loses his or her grip on the control bar. It is common for the tether to be connected to a band that the surfer wears around his or her wrist. The force on the tether, due to the wind in the kite, can result in considerable strain and damage to the surfers wrist, arm, and shoulder. In addition, surfers using a kite powered surfboard often perform various acrobatic stunts. These might include jumping into the air and rotating through a complete circle. However, such stunts can result in the kite control lines twisting about each other and in the tether becoming tangled with the kite control lines or becoming wrapped around the hook which hooks the surfer's harness to the kite control bar. Such hazards also can occur if the surfer falls.

DISCLOSURE OF THE INVENTION

The present invention is a control apparatus for a kite powered conveyance device which avoids such problems. In accordance with the present invention, a spreader bar assembly for use with a kite powered conveyance device having a control bar includes a spreader bar adapted for connection to a harness of a user of the kite powered conveyance device, an arm connected to the spreader bar and having a longitudinal axis, a tether connector mounted on the arm and adapted for connection thereto of a tether of the kite powered conveyance device to connect the tether to the spreader bar, and a hook mounted on the arm and adapted to be hooked to the control bar of the kite powered conveyance device to connect the control bar of the kite powered conveyance device to the spreader bar, wherein the tether connector and the hook are rotatably mounted on the arm for rotation about the longitudinal axis of the arm.

The tether connector may be formed integrally with the swivel hook. Preferably, a spring urges the arm to extend from the spreader bar. The arm may include a quick release member enabling release of the arm from the spreader bar. The tether connector may include a rotor member and a shackle member pivotally attached to the rotor member, and the hook may be a snap hook.

Further, in accordance with the present invention a control apparatus for a kite powered device includes a control bar adapted for connection by port and starboard kite leads and/or kite control lines to a kite of the kite powered device, a tether guide connected to an end of the control bar or adapted for connection to one of the kite leads, a spreader bar assembly as set forth above, and a tether connected to the tether connector, passing through the tether guide, and adapted for connection to one of the port and starboard kite control lines. Alternatively, the tether guide may be formed integrally with the control bar.

The tether guide may be a guide member having a first end connected to one end of the control bar or to one of the kite leads and a second end having a slot therein to receive the tether. Alternatively, the tether guide may be formed integrally with the control bar or with the kite leads. The slot preferably is sized in relationship to the tether to permit the tether guide to grip the tether in the slot, while allowing removal of the tether from the slot in response to pulling on the tether.

In addition, in accordance with the present invention, a kite powered conveyance device includes a kite having port and starboard ends, a control apparatus as set forth above, port and starboard kite leads and/or port and starboard kite control lines connecting the port and starboard ends of the control bar to the port and starboard ends, respectively, of the kite, and a harness connected to the spreader bar and adapted to be worn by a user of the kite powered conveyance device.

Additionally in accordance with the present invention, a tether guide includes a body member having a first end adapted for attachment to the control bar of the kite powered device or to one of the kite leads and a second end with a slot therein for passage therethrough of the tether of the kite powered conveyance device, the slot being sized in relationship to the tether to permit the tether guide to grip the tether in the slot, while allowing removal of the tether from the slot in response to pulling on the tether.

Even further, the present invention is a control bar for use with a control apparatus of a kite powered conveyance device having a kite, kite control lines connecting the kite to the control bar, and a tether connected to the kite. The control bar includes a bar member, and a tether guide formed integrally with the bar member. The tether guide has a slot therein for passage therethrough of the tether, the slot being sized in relationship to tether to permit the tether guide to grip the tether in the slot, while allowing removal of the tether from the slot in response to pulling on the tether. The slot may terminate within the tether guide in a circular portion, and circular portion may have a diameter greater than the width of the slot.

BRIEF DESCRIPTION OF THE DRAWINGS

These and other aspects and advantages of the present invention are more apparent from the following detailed description and claims, particularly when considered in conjunction with the accompanying drawings. In the drawings:

BEST MODE FOR CARRYING OUT THE INVENTION

Figure 1:
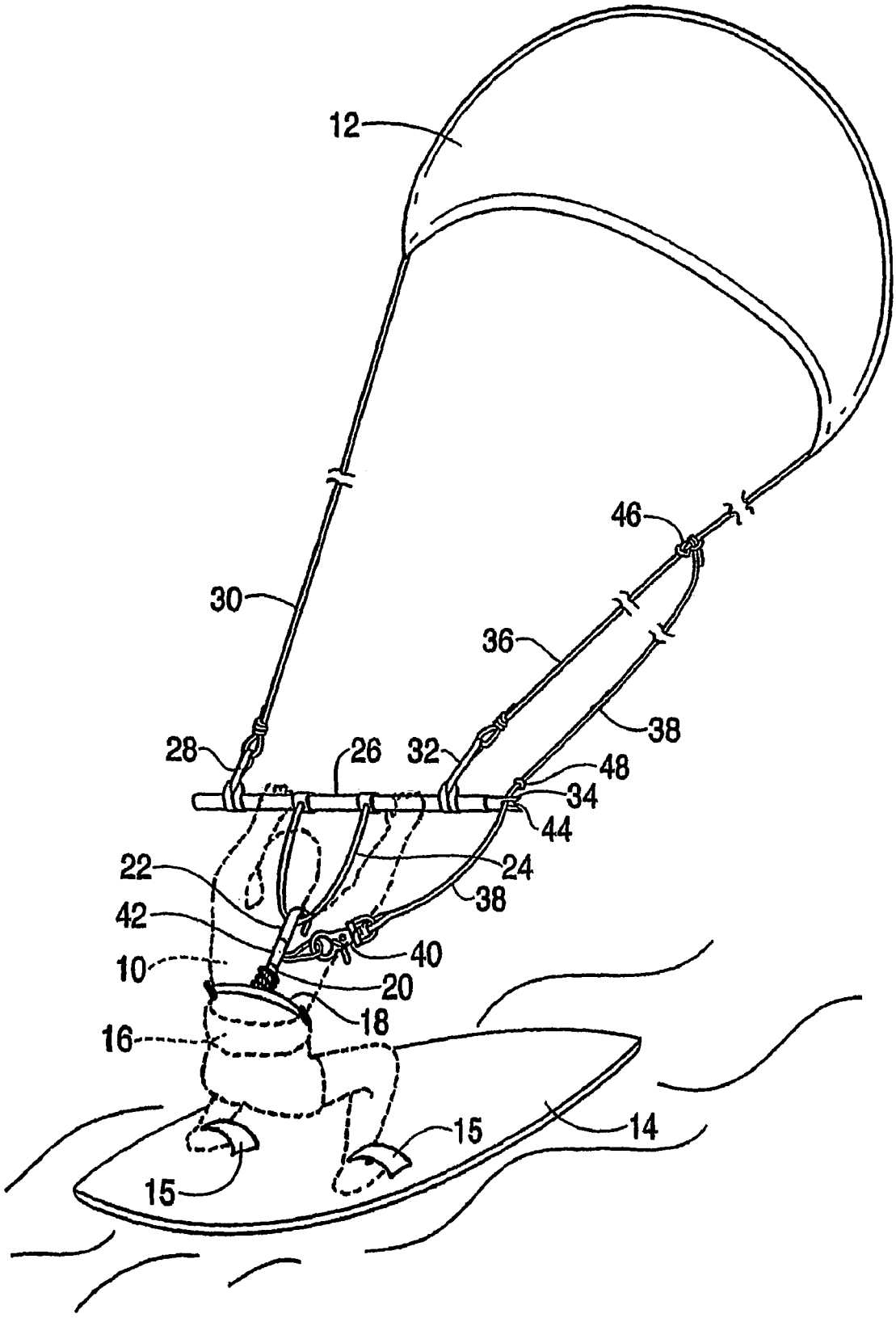
FIG. 1 is a perspective view of a kite surfer on a kite powered surfboard.
Figure 2:
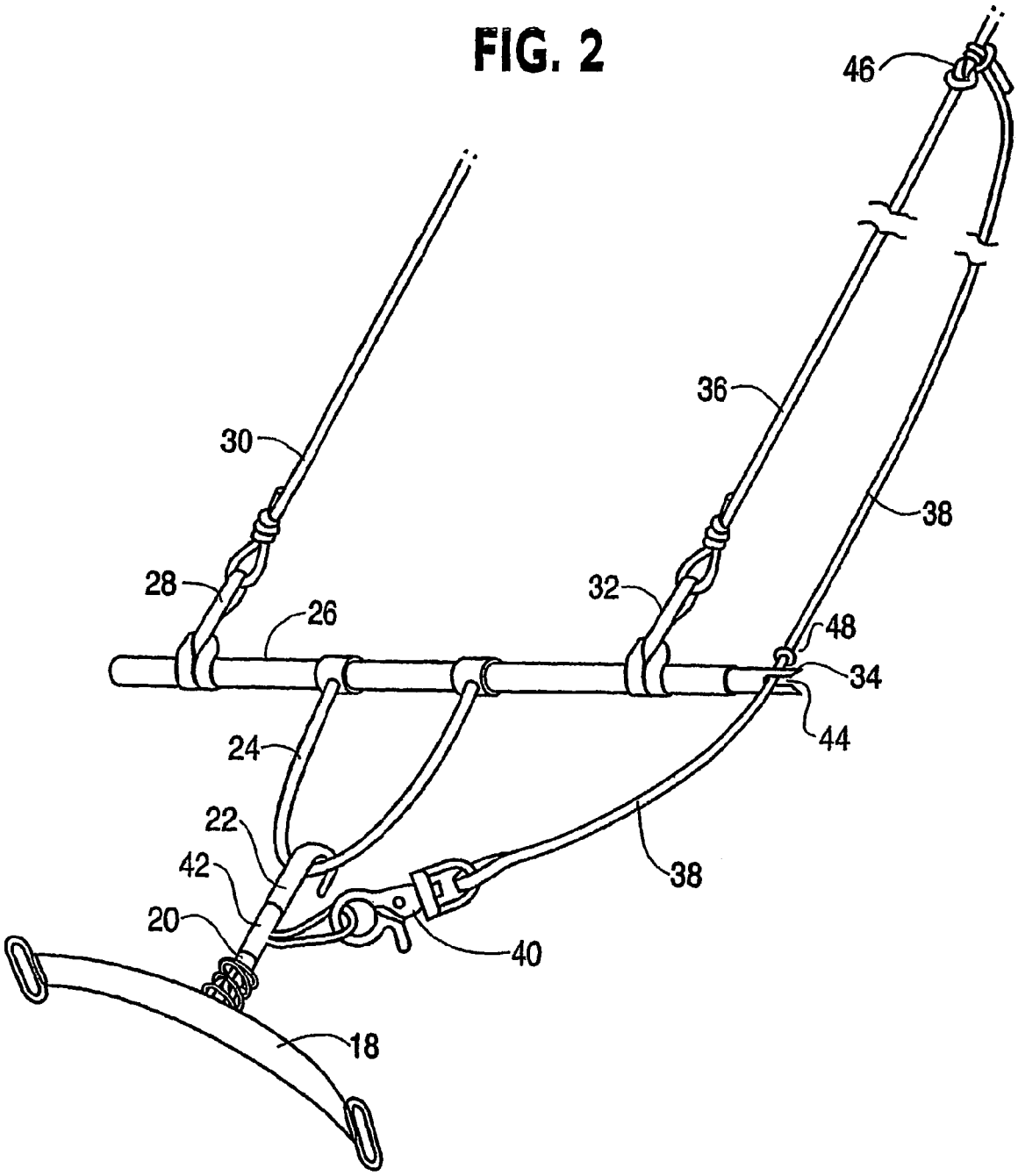
FIG. 2 is a perspective view of an embodiment of a control apparatus for a kite powered conveyance device in accordance with the present invention.

FIGS. 1 and 2 depict a preferred embodiment of a control apparatus for a kite powered conveyance device in accordance with the present invention. FIG. 1 depicts a surfer 10 being towed by a kite 12 while standing on a surfboard 14, with the surfer's feet within straps 15 of the surfboard. Surfer 10 is wearing a harness 16 which connects with a spreader bar 18 that passes across the waist of surfer 10. An arm 20 extends from spreader bar 18. A hook 22 is rotatably mounted on arm 20 and is hooked on harness line 24 of a control bar 26 for kite 12, thus hooking spreader bar 18 to control bar 26.

One end of a port kite control line 30 is connected to the port side of kite 12. The second end of port kite control line 30 is connected to port kite lead 28 which is tied about control bar 26 adjacent the port end of the control bar. Similarly, one end of a starboard kite control line 36 is connected to the starboard side of kite 12, and the second end of starboard kite control line 36 is connected to starboard kite lead 32 which is tied about control bar 26 adjacent the starboard end of the control bar.

Tether guide 34 is connected to one end of control bar 26, illustratively depicted in FIGS. 1 and 2 as the starboard end. A tether 38 passes through a slot 44 in tether guide 34 and has its first end connected by a snap hook 40 to a tether connector 42 that is rotatably mounted on arm 20 and its second end tied by a knot 46 to starboard kite control line 36. Preferably, tether stopper 48 is positioned on tether 38, beyond tether guide 34.

During kite surfing, surfer 10 grips control bar 26 and stands on surfboard 14, with the surfer's feet within straps 15. Hook 22 is hooked onto harness line 24. As a result, as wind blows kite 12 the surfer is pulled over the water. When surfer 10 desires to depower kite 12, the surfer lets go of control bar 26. Tether 38 pulls free from tether connector 42 and, through starboard kite control line 36, continues to exert a force on the starboard side of kite 12. Because surfer 10 is no longer gripping control bar 26, there is little force exerted on the port side of kite 12 by port kite control line 30. Consequently, kite 12 turns and no longer is blown strongly by the wind, thus depowering. Kite 12 therefore falls to the surface of the water or earth. Even if the surfer has fallen and hook 22 has detached from harness line 24, tether 38 and starboard kite control line 36 retain the connection between surfer 10 and kite 12, so that the surfer does not lose the kite. Using tether 38, the surfer may be able to control the location at which kite 12 settles to the surface, avoiding other surfers, swimmers, boats, and similar objects. The surfer can then retrieve kite 12 by pulling in tether 38 and starboard kite control line 36.

Surfer 10 may wish to perform an acrobatic stunt, for example jumping into the air and rotating through a full circle while straps 15 retain the surfer's feet in contact with surfboard 14. In such a stunt, control bar 26 rotates with respect to the longitudinal axis of arm 20, causing kite control lines 30 and 36 to twist about each other. Once surfer 10 has resettled on the water, he or she can rotate control bar 26, together with hook 22 and tether connector 42, in the opposite direction about arm 20 to untwist kite control lines 30 and 36. Tether 38 rotates about arm 20 with tether connector 42, therefore preventing tether 38 from wrapping about arm 20.

If the kite surfer falls from the surfboard, losing his or her grip on control bar 26, tether 38 pulls from slot 44 of tether guide 34. Port kite control line 30 exerts little force on the port side of kite 12, while tether 38 and starboard kite control line 36 continue to exert force on the starboard side of the kite. Consequently, kite 12 depowers, causing the kite to descend to the surface of the water or ground.

Figure 3:
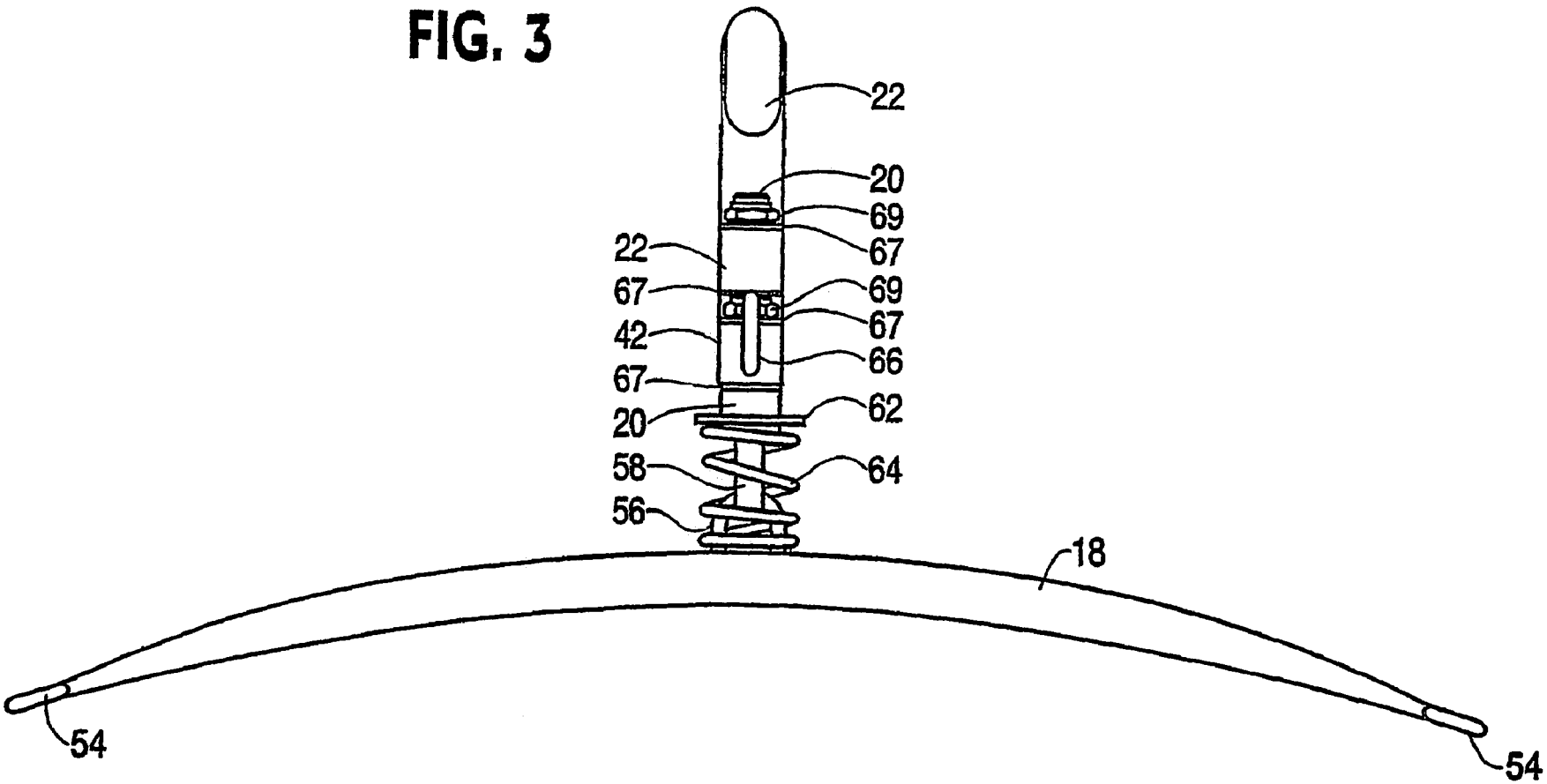
FIG. 3 is a bottom plan view of an embodiment of a spreader bar assembly for use in a control apparatus for a kite powered conveyance device in accordance with the present invention.
Figure 4:
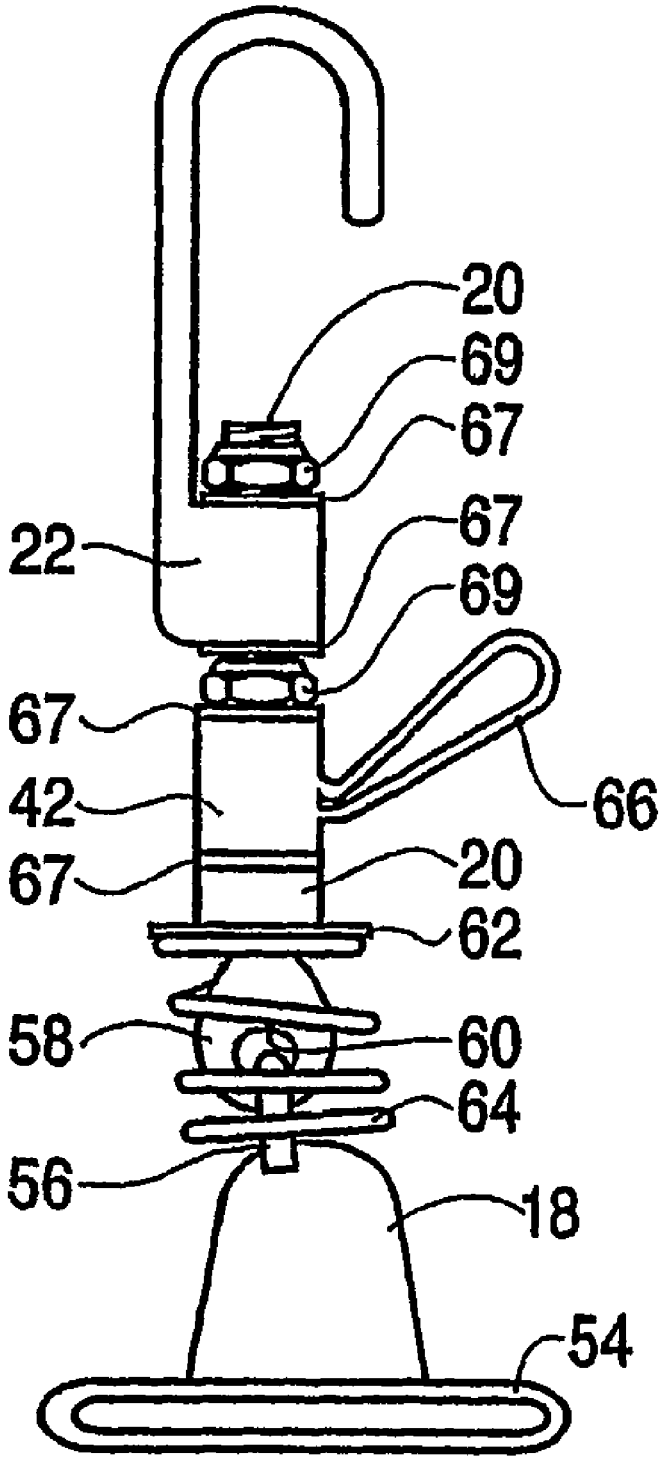
FIG. 4 is a side view of the spreader bar assembly of FIG. 3.

FIGS. 3 and 4 depict a first embodiment of a spreader bar assembly in accordance with the present invention. Spreader bar 18 has a loop 54 at each end, permitting attachment of the spreader bar to harness 16. A U-shaped connector 56 extends from substantially the center of spreader bar 18. A second connector 58 extends from the end of arm 20. Connector 56 passes through an opening 60 in connector 58, connecting arm 20 to spreader bar 18 in a universal joint type connection. A washer 62 is rigidly fastened on arm 20. A coiled spring 64 encircles connectors 56 and 58 and extends between washer 62 and spreader bar 18, biasing arm 20 to extend from spreader bar 18.

Tether connector 42 is rotatably mounted on arm 20. Tether connector 42 includes a connection arm 66 which extends at an angle with the longitudinal axis of arm 20. Hook 22 is also rotatably mounted on arm 20. Tether connector 42 and hook 22 are retained in place and rotatable by suitable washers 67 and nuts 69, as appropriate, with arm 20 being threaded as needed. As can be seen in FIGS. 1 and 2, snap hook 40 connects tether 38 to tether connector 42. Because hook 22 and tether connector 42 are rotatable on arm 20, when an acrobatic stunt has caused kite control lines 30 and 36 to twist about each other, control bar 26 can be rotated in the opposite direction to untwist the kite control lines and to rotate tether 38 about arm 20, therefore preventing tether 38 from wrapping about arm 20.

Figure 5:
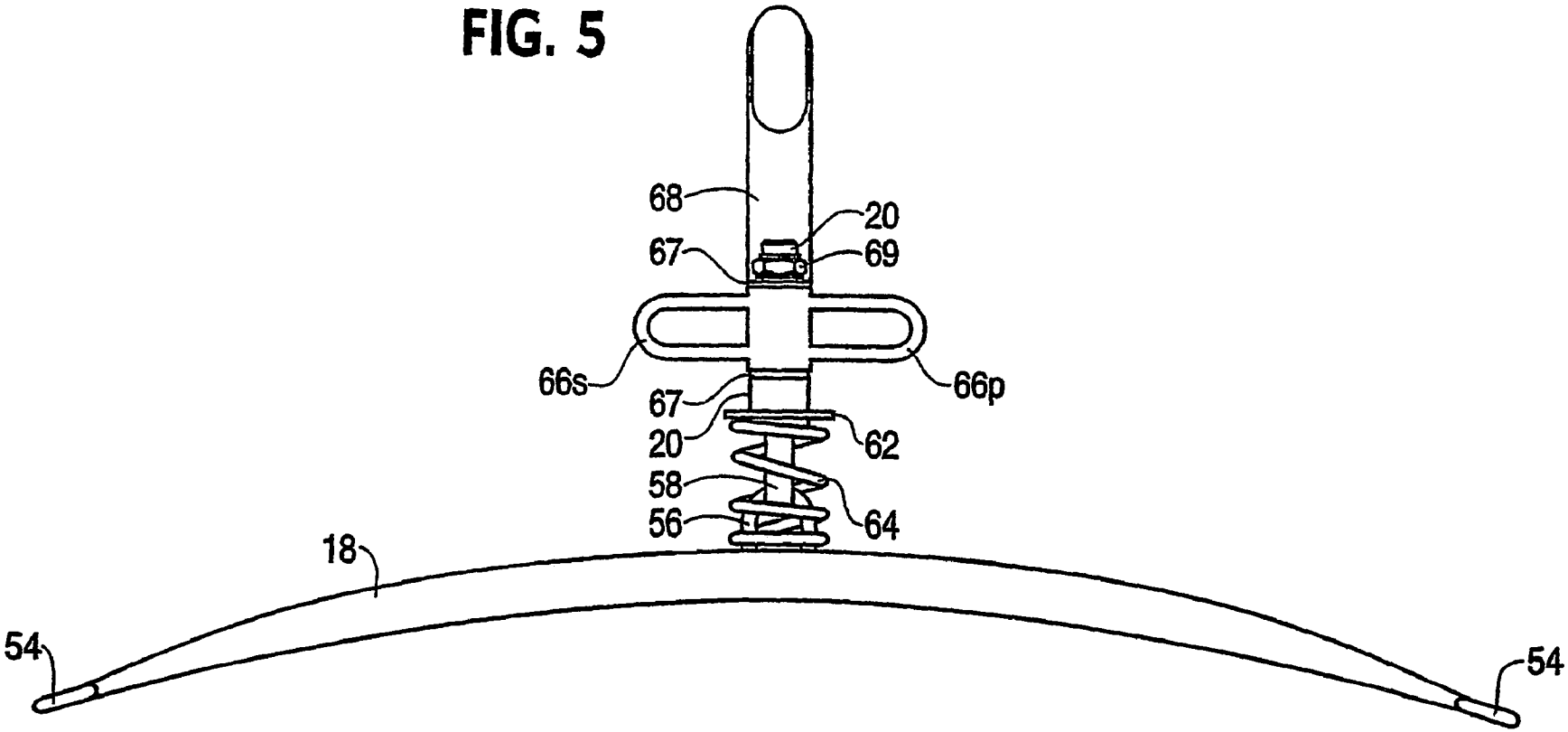
FIG. 5 is a bottom plan view of another embodiment of a spreader bar assembly for use in a control apparatus for a kite powered conveyance device in accordance with the present invention.
Figure 6:
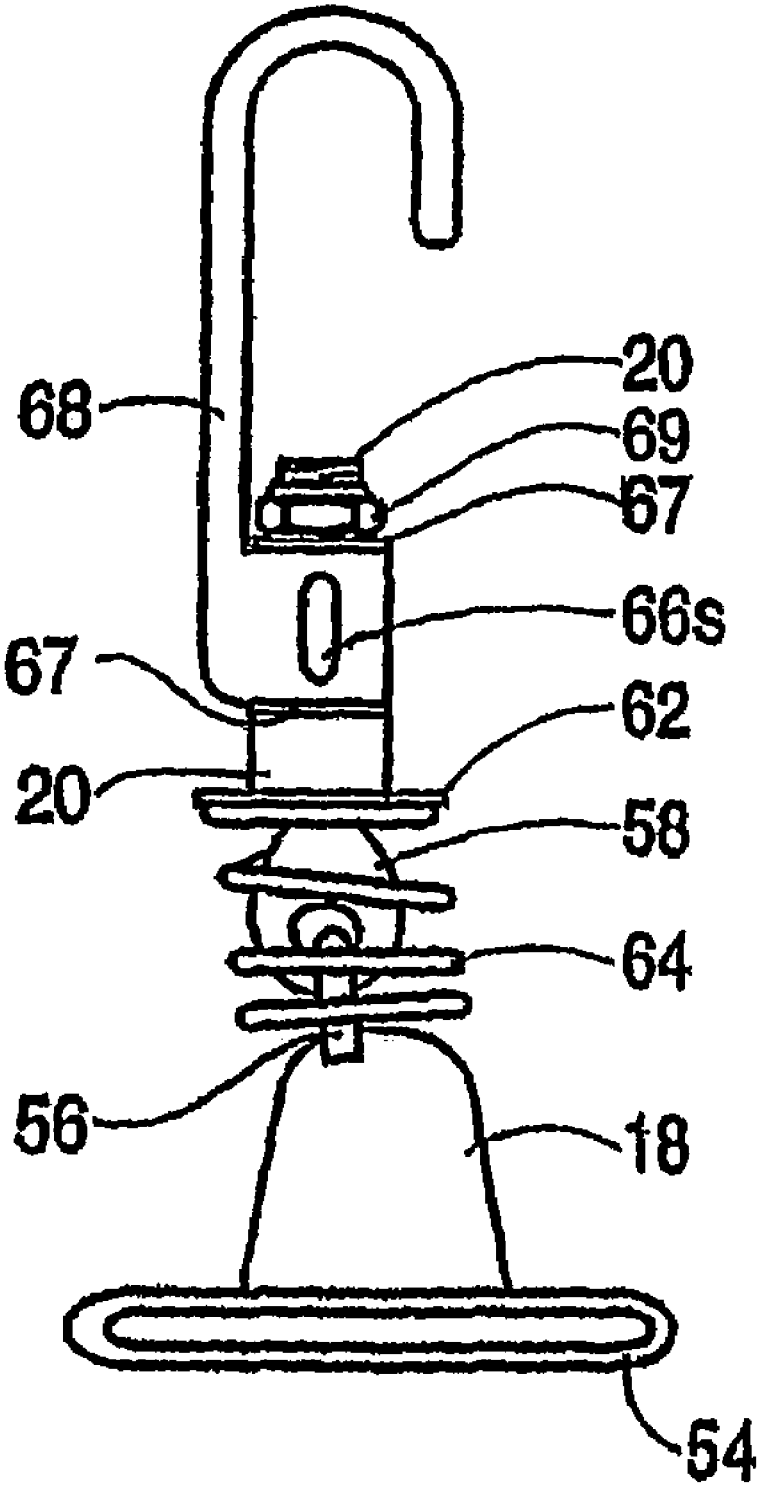
FIG. 6 is a side view of the spreader bar assembly of FIG. 5.

FIGS. 5 and 6 depict a second embodiment of a spreader bar assembly in accordance with the present invention which differs from the embodiment of FIGS. 3 and 4 by replacing hook 22 and tether connector 42 of FIGS. 3 and 4 with an integral hook and connector 68. In addition, both a port connection arm 66*p* and a starboard connection arm 66*s* are provided, permitting the selection of the side of kite 12 to which tether 38 is connected.

Figure 7:
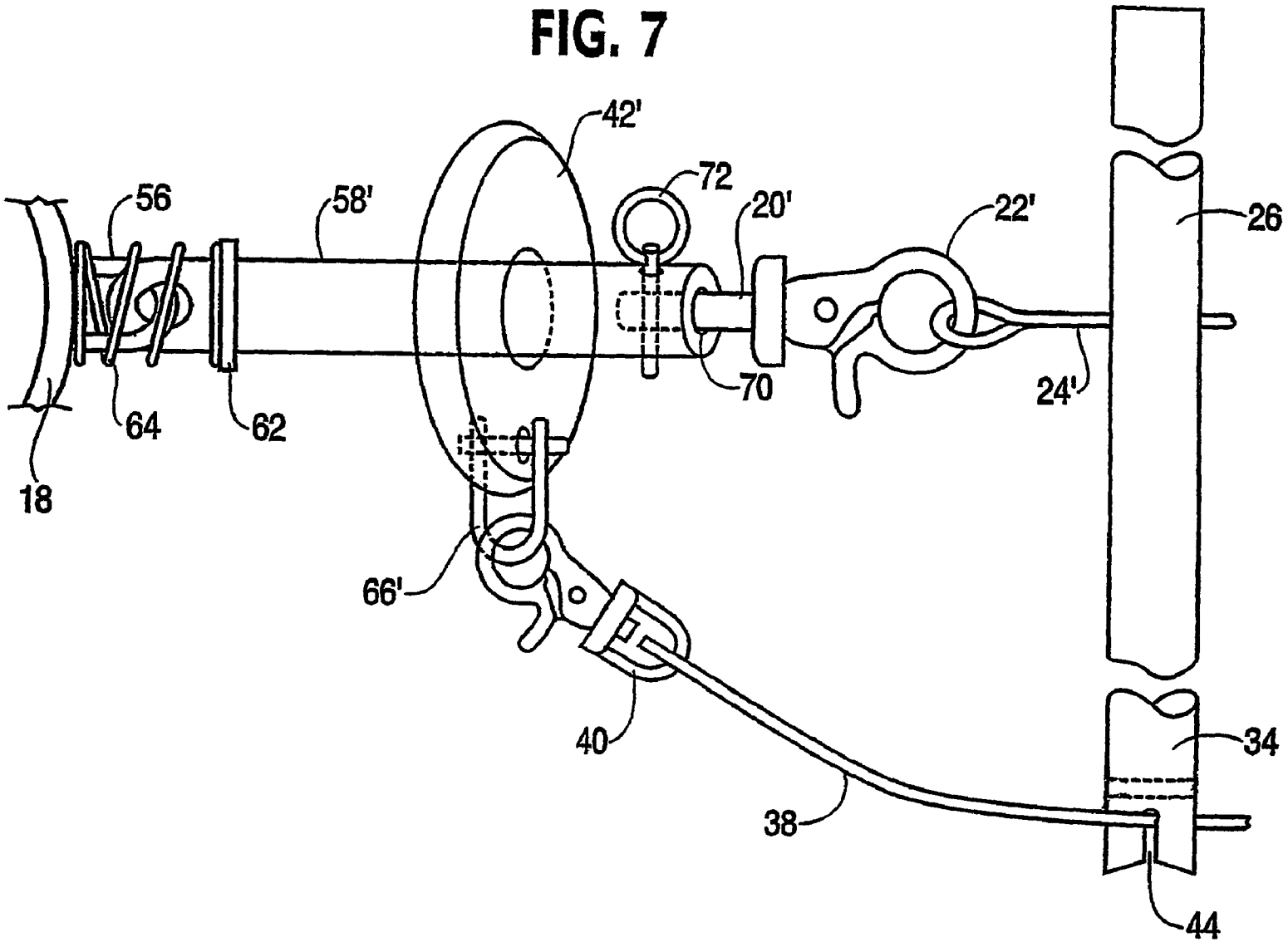
FIG. 7 is a perspective view of another embodiment of a control apparatus for a kite powered conveyance device in accordance with the present invention.

FIG. 7 depicts another embodiment of a control apparatus for a kite powered device in accordance with the present invention. Tether rotor 42' is mounted on connector 58', being freely rotatably thereon. Arm 20' is inserted into opening 70 of connector 58' and held within that opening by quick release pin 72 which passes through a second opening through connector 58' and arm 20'. Tether rotor 42' is a circular disk and preferably is positioned between two sets of washers and nuts (not shown) on connector 58'. Snap hook 40 on the end of tether 38 is connected to D shackle 66' that is fastened on tether rotor 42'. Snap hook 22' is attached (preferably rotatably) to the end of arm 20' and is hooked on harness line 24' of control bar 26' for the kite. FIG. 7 depicts harness line 24' as a flexible line which passes through control bar 26' to connect to two lines of a kite having four kite control lines. In case of a fall or other emergency, the surfer can pull quick release pin 72 from connector 58', permitting arm 20' to separate from connector 58'. Tether 38 remains connected to tether rotor 42', causing the kite 12 to depower and avoiding loss of the kite.

Figure 8:
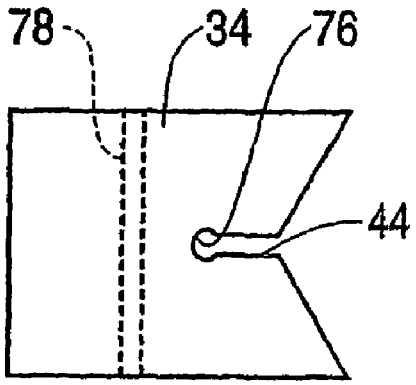
FIG. 8 is a side elevational view of a preferred embodiment of a tether guide in accordance with the present invention.
Figure 9:
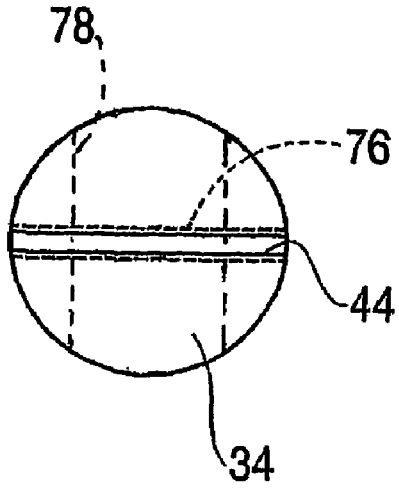
FIG. 9 is an end elevational view of the tether guide of FIG. 8.
Figure 10:
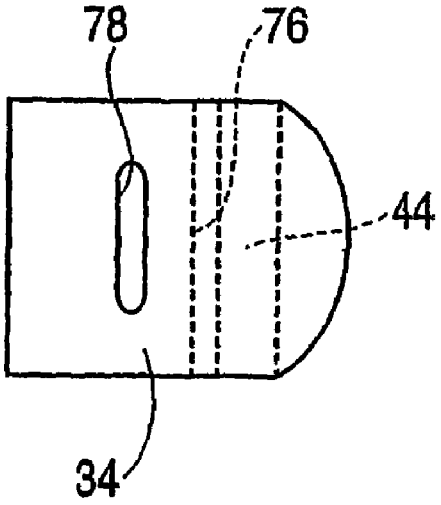
FIG. 10 is a top plan view of the tether guide of FIG. 8.
Figure 11:
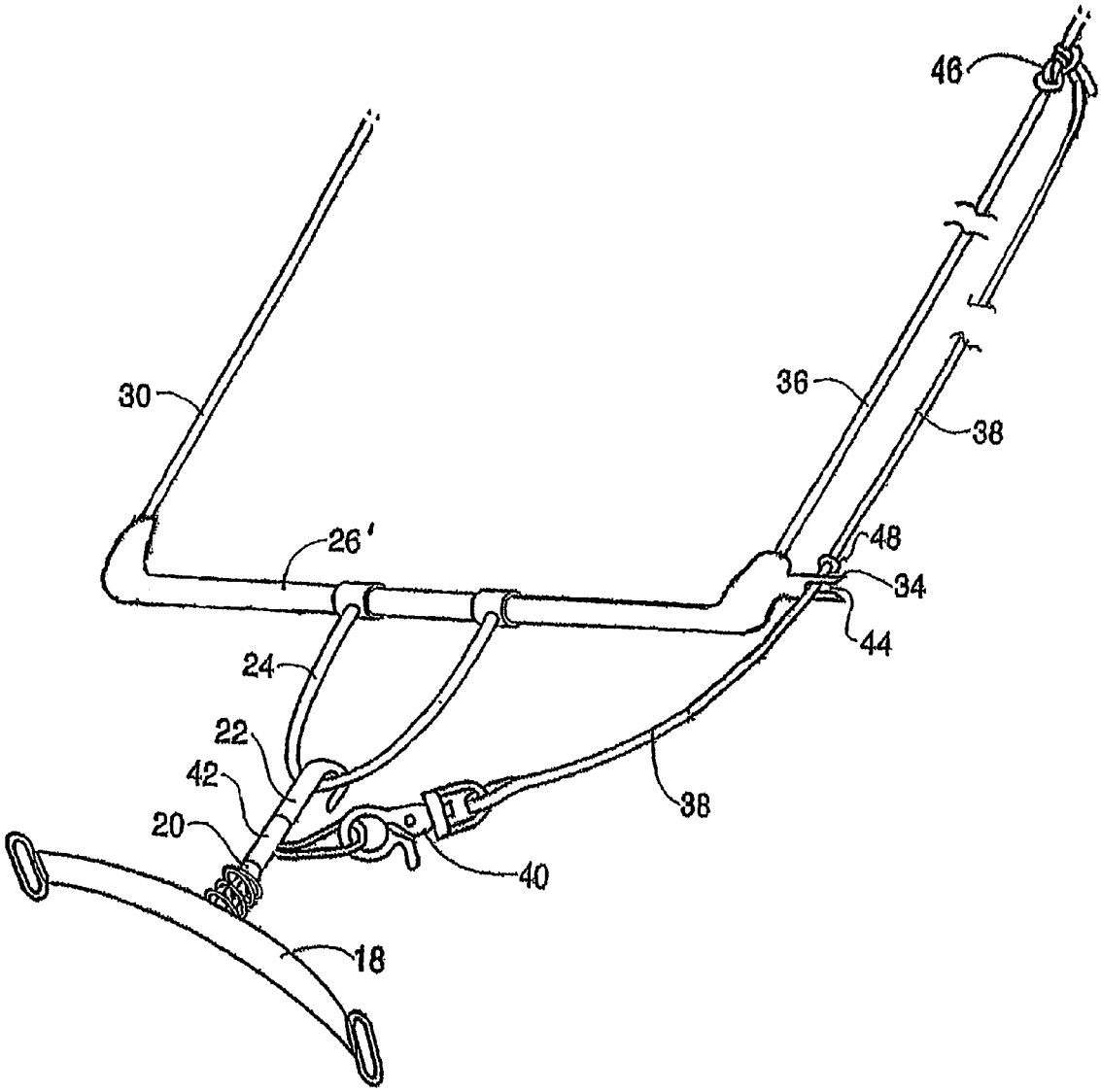
FIG. 11 is a perspective view of another embodiment of a control apparatus for a kite powered device in accordance with the present invention.
Figure 12:
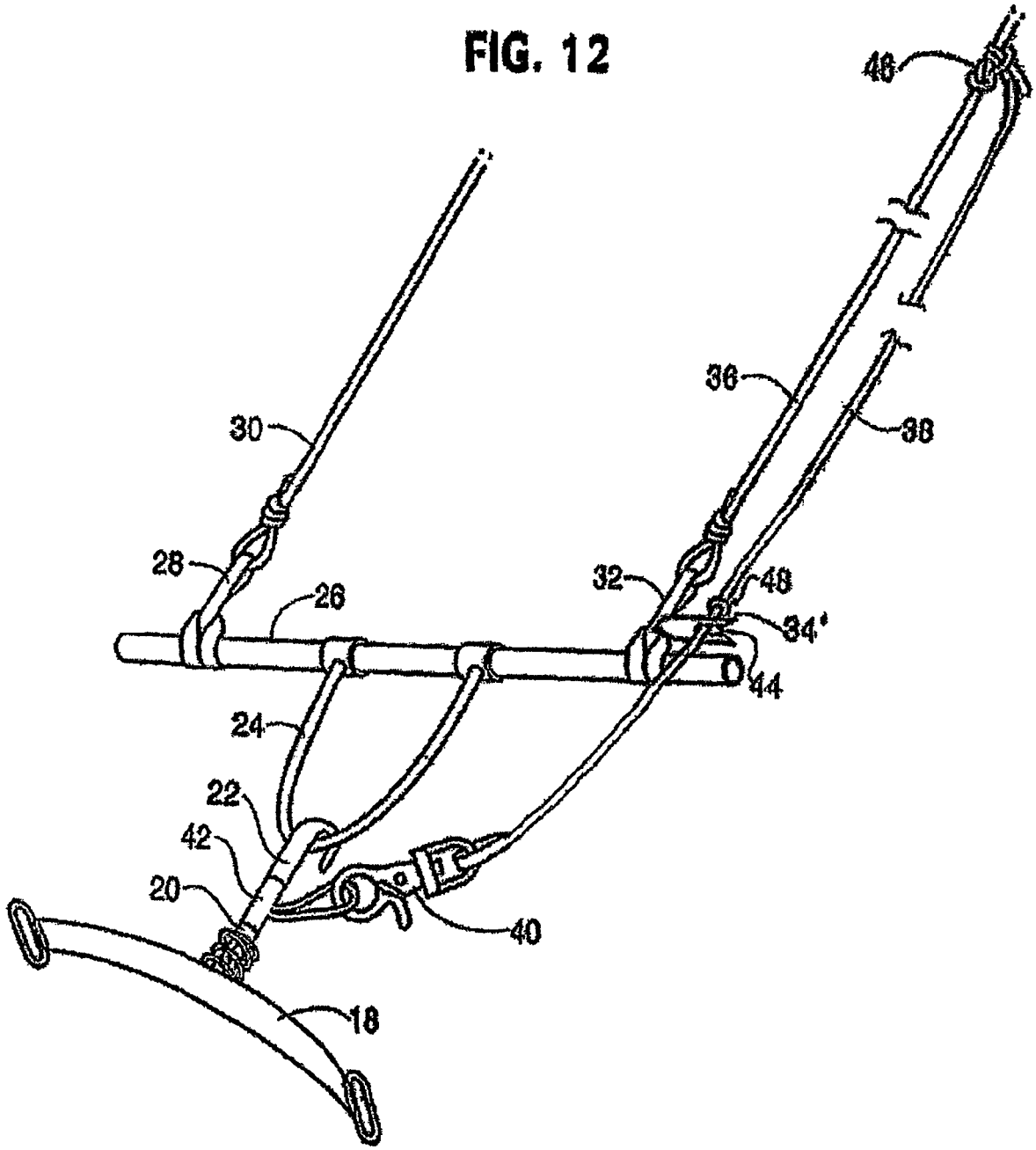
FIG. 12 is a perspective view of a further embodiment of a control apparatus for a kite powered device in accordance with the present invention.

FIGS. 8, 9, and 10 depict a preferred embodiment of a tether guide 34 in accordance with the present invention. As seen in FIG. 9, tether guide 34 has a circular cross section with a diameter substantially equal to that of control bar 26. One end of tether guide 34 (the left end as depicted in FIGS. 8 and 10) is shaped to conform to the end of control bar 26. Thus, that end of the tether guide might be substantially flat as depicted in FIGS. 8 and 10, concave, or other shape depending upon the configuration of the end of control bar 26. Alternatively, a tether guide 34' can be formed integrally with a control bar 26', as depicted in FIG. 11. As a further alternative, as depicted in FIG. 12 the end of tether guide 34" can be secured on either kite lead 28 or 32 near the end of control bar 26, being thus still connected to the end of the control bar, with the end of tether guide 34" being shaped to conform to the kite lead.

A slot 44 extends from the opposite end surface into tether guide 34, 34', 34" a short distance, for example a distance in the order of about one-fourth inch. Slot 44 goes across the full width of tether guide 34, 34', 34". Preferably, that opposite end of tether guide 34 is shaped to ease entry of tether 38 into slot 44, for example being recessed as depicted in FIGS. 8-10. Slot 44 terminates in a circular portion 76. An opening 78 passes through tether guide 34, 34', 34" at substantially a right angle to slot 44.

Tether guide 34 can be secured to control bar 26 by one or more fasteners passing through opening 78 and secured to the control bar. Alternatively, tether guide 34" can be secured to kite lead 28 or 32 by one or more fasteners passing through opening 78 and secured to the kite lead. As further alternatives, the tether guide can be formed integrally with the control bar, as in FIG. 11, or with one of the kite leads. Tether line 38 then is pulled into slot 44 to pass through the circular portion 76. Tether guide 34, 34', 34" is preferably made of a resilient material. Slot 44 and circular portion 76 are sized in conjunction with the resiliency of the material from which tether guide 34, 34', 34" is made to permit tether 38 to be loosely gripped within circular portion 76 and to pass through slot 44 when pulled to depower kite 12. By way of example, if tether 38 has a diameter of one-eighth inch and if tether guide 34, 34', 34" is formed of a soft elastomeric material such as soft polyurethane, slot 44 might have a width of one-sixty-fourth inch, and circular portion 76 might have a diameter of one-eighth inch. In one preferred embodiment, slot 44 is formed by a hot wire cutting into the tether guide. For a less resilient material, slot 44 might have a width of one-sixteenth inch. Tether stopper 48 prevents tether 38 from pulling out of slot 44 during normal kite surfing. When surfer 10 desires to depower kite 12, the surfer pulls on tether 38, pulling the tether out of slot 44. Continued pulling on tether 38, and thus on kite control line 36, results in depowering of kite 12. Likewise, should surfer 10 fall and loss his or her grip on control bar 26, tether 38, being connected to tether connector 42 on arm 20, continues to exert a force on kite control line 36, while kite control line 30 is limp, depowering kite 12.

Although the invention has been described with reference to preferred embodiments, various substitutions, rearrangements, and alterations might be made, and still the result would be within the scope of the invention.

What is claimed is:

1. A spreader bar assembly for use with a conveyance device having a control element, said spreader bar assembly including a spreader bar; an arm connected to said spreader bar and having a longitudinal axis; and a hook mounted on said arm and adapted to be hooked to the control element of the conveyance device to connect the control element of the conveyance device to said spreader, further characterized by said arm being pivotally connected to said spreader bar, and by a spring urging said arm to extend from said spreader bar.

2. A spreader bar assembly as claimed in claim 1, further characterized by a tether connector being formed integrally with said hook.

3. A spreader bar assembly as claimed in claim 1, further characterized by a quick release member enabling release of said arm from said spreader bar.

4. A spreader bar assembly as claimed in claim 1, further characterized by said hook being a snap hook.

5. A spreader bar assembly as claimed in claim 1, further characterized by said hook being rotatably mounted on said arm for rotation about the longitudinal axis of said arm.

6. A spreader bar assembly as claimed in claim 1, further characterized by said control element comprising a control bar adapted to be used with a wind powered conveyance device.

7. A spreader bar assembly as claimed in claim 1, further characterized by said control element comprising a control apparatus adapted to be used with a selfpropelled conveyance device.

8. A spreader bar assembly as claimed in claim 1, further characterized by a quickrelease member enabling release of said hook from said arm.

9. A spreader bar assembly for use with a conveyance device having a control element, said spreader bar assembly including a spreader bar; an arm connected to said spreader bar and having a longitudinal axis; and a hook mounted on said arm and adapted to be hooked to the control element of the conveyance device to connect the control element of the conveyance device to said spreader, further characterized by a tether connector including a rotor member and a shackle member pivotally attached to said rotor member.

10. A spreader bar assembly as claimed in claim 9, further characterized by a tether connector being formed integrally with said hook.

11. A spreader bar assembly as claimed in claim 9, further characterized by a quick release member enabling release of said arm from said spreader bar.

12. A spreader bar assembly as claimed in claim 9, further characterized by said hook being a snap hook.

13. A spreader bar assembly as claimed in claim 9, further characterized by said hook being rotatably mounted on said arm for rotation about the longitudinal axis of said arm.

14. A spreader bar assembly as claimed in claim 9, further characterized by said control element comprising a control bar adapted to be used with a wind-powered conveyance device.

15. A spreader bar assembly as claimed in claim 9, further characterized by said control element comprising a control apparatus adapted to be used with a self-propelled conveyance device.

16. A spreader bar assembly as claimed in claim 9, further characterized by a quick-release member enabling release of said hook from said arm.

* * * * *